US006510827B2

(12) United States Patent
Schreeck et al.

(10) Patent No.: US 6,510,827 B2
(45) Date of Patent: Jan. 28, 2003

(54) ACCESSORY DRIVE FOR THE VALVES OF AN INTERNAL COMBUSTION ENGINE

(75) Inventors: Nico Schreeck, Lauenau (DE); Dietmar Lagies, Braunschweig (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 10/055,548

(22) Filed: Jan. 23, 2002

(65) Prior Publication Data

US 2002/0104497 A1 Aug. 8, 2002

(30) Foreign Application Priority Data

Jan. 23, 2001 (DE) ..... 101 02 767

(51) Int. Cl.[7] ..... F01L 1/344

(52) U.S. Cl. ..... 123/90.17; 123/90.31; 74/568 R

(58) Field of Search ..... 123/90.15, 90.17, 123/90.31; 74/568 R

(56) References Cited

U.S. PATENT DOCUMENTS 4,658,769 A * 4/1987 Horio et al. ..... 123/90.31
5,931,126 A * 8/1999 Eguchi et al. ..... 123/90.17
5,988,126 A * 11/1999 Strauss et al. ..... 123/90.17
6,269,785 B1 * 8/2001 Adachi ..... 123/90.17
6,363,897 B2 * 4/2002 Scheidt et al. ..... 123/90.17

FOREIGN PATENT DOCUMENTS

DE 198 40 659 3/2000

* cited by examiner

*Primary Examiner*—Weilun Lo
(74) *Attorney, Agent, or Firm*—Cohen, Pontani, Lieberman & Pavane

(57) ABSTRACT

An accessory drive for the valves of an internal combustion engine, especially an Otto engine, especially for a motor vehicle, with at least one camshaft, which is divided into two camshaft halves. A camshaft gear wheel is provided between the two halves of the camshaft. A hydraulic camshaft adjuster is installed between the two halves of the camshaft. This adjuster is designed as a thrust bearing for each of the two halves of the camshaft, and each camshaft half has a hydraulic fluid connection extending via the associated thrust bearing to the camshaft adjuster.

15 Claims, 10 Drawing Sheets

ACCESSORY DRIVE FOR THE VALVES OF AN INTERNAL COMBUSTION ENGINE

BACKGROUND OF THE INVENTION

The invention pertains to an accessory drive for the valves of an internal combustion engine, especially an Otto engine, especially for a motor vehicle, with at least one camshaft, which is divided into two camshaft halves. A camshaft gear wheel is provided between the two halves of the camshaft.

In internal combustion engines with variable control times achieved by means of an appropriate camshaft adjusting system, the valve opening and/or closing times can be adapted more effectively to the highly dynamic gas exchange process. The advantages of variable control times include above all a gas-exchange loop optimized with respect to losses, improved filling of the cylinders, and the possibility of internal exhaust gas return in the partial-load range by means of a correspondingly large valve overlap.

An accessory drive which has camshaft gear wheels seated on the camshafts in a central position is known from DE 198-40,659 A1.

SUMMARY OF THE INVENTION

Accordingly, it is an object of the present invention to provide an accessory drive of the type indicated above with respect to the space it occupies without any loss of performance, so that this drive can also be used in internal combustion engines with a large number of cylinders, such as 18 cylinders, without the need for complicated modifications to the engine itself.

Pursuant to this object, and others which will become apparent hereafter, one aspect of the present invention resides in an accessory drive in which a hydraulic camshaft adjuster is installed between the two halves of the camshaft. The adjuster is designed as a thrust bearing for the two halves of the camshaft. Each half of the camshaft has a hydraulic fluid connection extending via the associated thrust bearing to the camshaft adjuster.

This offers the advantage that, in a simple and low-cost manner, a continuous phase adjustment at a crank angle of at least 40° is made available in a small amount of space, so that, on existing engines with center power takeoff, only slight modifications or adaptations are required for the installation of the accessory drive according to the invention. In addition. the hydraulic fluid serves simultaneously as a lubricating medium for the thrust bearings by flowing to, over, and away from them.

So that the amount of space occupied is as small as possible, the camshaft gear wheel is integrated into the camshaft adjuster, and the camshaft adjuster is preferably designed as a vane cell adjuster. The vane cell adjuster has an impeller and a vane cell wheel. The impeller has five or six vanes, and the vane cell wheel has five or six vane cells.

An especially compact and space-saving arrangement without loss of performance can be achieved by providing the vane cell adjuster with the following geometry,: wall thickness, 3 mm; outside diameter, 66 mm; inside diameter, 34 mm to 36 mm; width, 21 mm to 24 mm, and preferably 22 mm; effective area per vane, 315 $mm^2$ to 384 $mm^2$, and preferably 330 $mm^2$, 360 $mm^2$, 336 $mm^2$, or 372 $mm^2$; effective diameter, 25 mm to 26 mm, and preferably 25.5 mm.

In a preferred embodiment, the camshaft adjuster is connected by way of end pieces to each of the two halves of the camshaft, and a hydraulic fluid connection extending between the camshaft half and the camshaft adjuster is provided in each end piece. Here it is preferred for each end piece to be inserted into an interior space in the half of the camshaft. When two end pieces are assigned to a camshaft adjuster, it is advisable for the hydraulic fluid connection to be external for the one end piece and internal for the other.

It should be pointed out that, within the scope of the overall disclosure, the term "camshaft half" is not meant to signify necessarily an exact geometric division into two identical halves. Instead, the term also covers dimensions for these two parts of a camshaft which do not represent a division into two precisely equal halves.

Regardless of how the end pieces and the camshaft adjuster are arranged, a central screw is provided, which clamps the camshaft adjuster to the associated end pieces installed at the ends.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PREFERRED EMBODIMENTS

Figure 19:
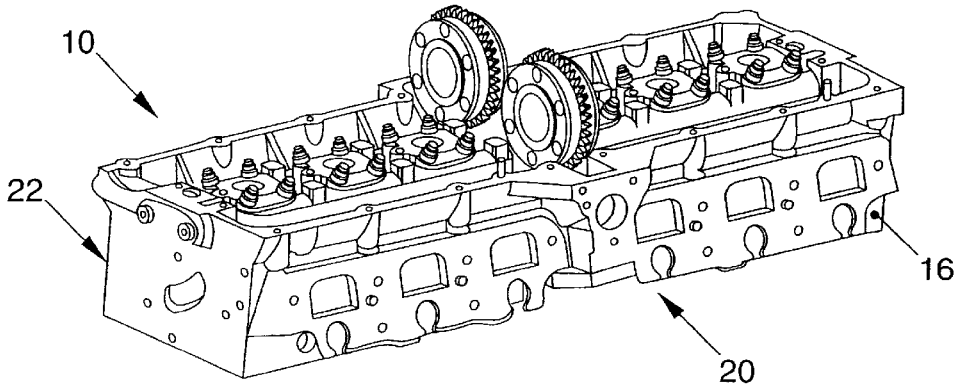
FIG. 19 is a perspective view of a cylinder bank of an internal combustion engine with an accessory drive designed in accordance with the invention in a first phase of the assembly procedure.
Figure 20:
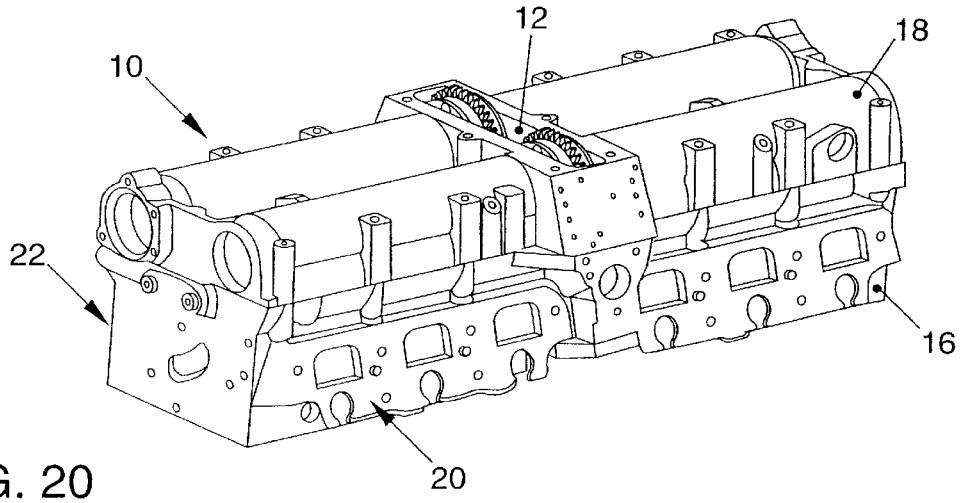
FIG. 20 is a perspective view of the cylinder bank of FIG. 19 of an internal combustion engine with an accessory drive designed in accordance with the invention in a second phase of the assembly procedure.
Figure 21:
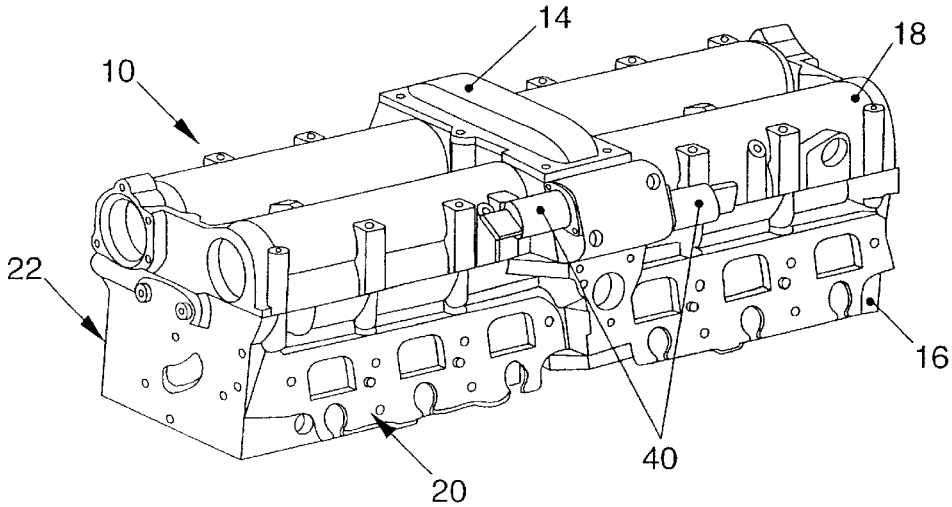
FIG. 21 is a perspective view of the cylinder bank of FIG. 19 of an internal combustion engine with an accessory drive designed in accordance with the invention in a third phase of the assembly procedure.

The invention is explained below merely by way of example on the basis of a direct-injection W18 Otto engine with several banks of cylinders. FIGS. 19–21 show a cylinder bank 10 in perspective with a chain shaft 12, in which a central takeoff for a valve control is located. A chain shaft cover 14, a cylinder head 16, and a cylinder head cover or cylinder head shroud 18 are also shown. The cylinder head 16 has an intake side 20 and an exhaust side 22, and an intake camshaft and an exhaust camshaft are provided in the cylinder head 16. The contours of the camshafts are reflected in the shape of the cylinder head shroud 18 as seen in FIGS. 20 and 21.

FIGS. 1–4 show various views of the accessory drive according to the invention in the area of the chain shaft 12. The camshafts are divided in the area of the chain shaft 12 into a first camshaft half 24 and a second camshaft half 26. In the area of the division, a camshaft adjuster 28 in the form of a vane cell adjuster is connected to each of the two camshaft halves 24, 26 by way of end pieces 30, 32. The end pieces 30, 32 are inserted into the camshaft halves 24, 26 and connected to the vane cell adjuster 28 at the ends facing away from their associated camshaft halves 24, 26.

Figure 1:
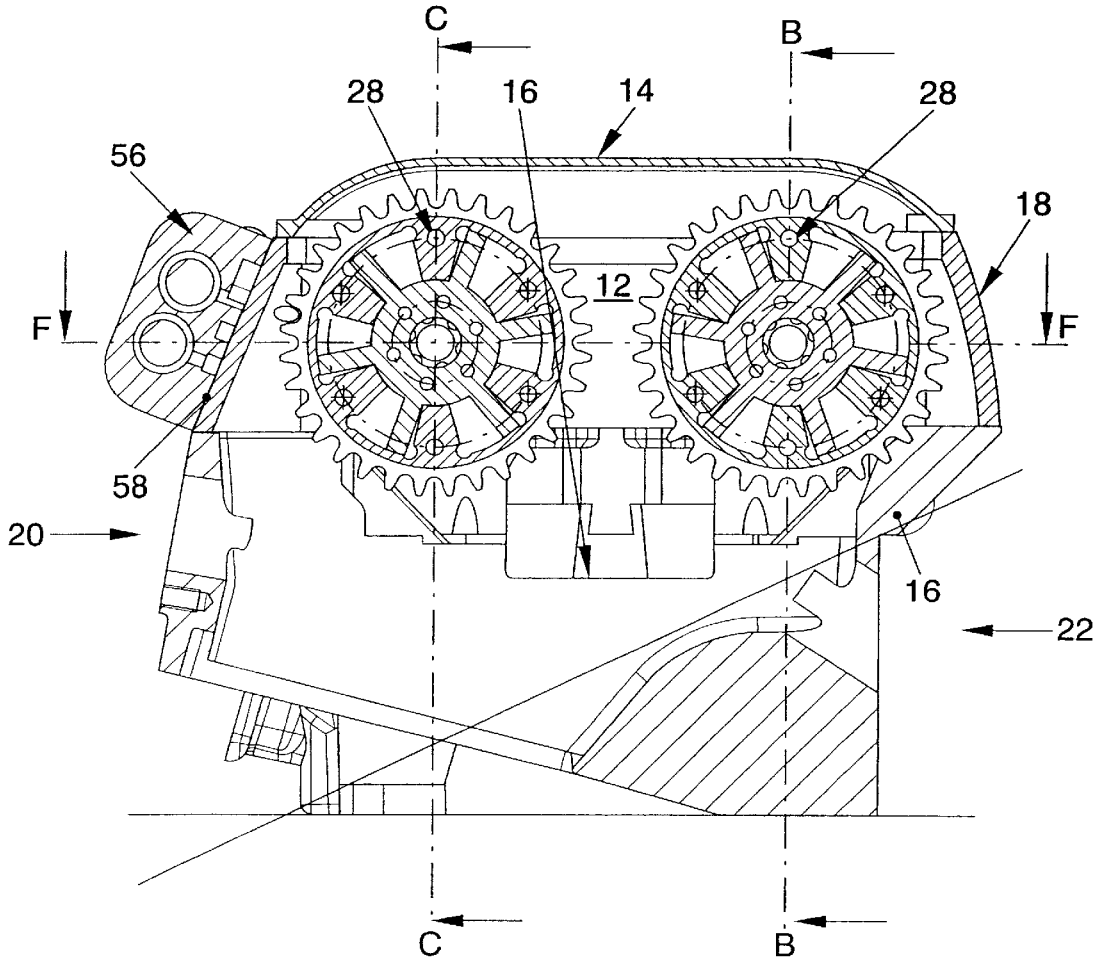
FIG. 1 is a sectional view of a cylinder head with a preferred embodiment of an accessory drive according to the invention at the level of the chain shaft of the cylinder head.
Figure 2:
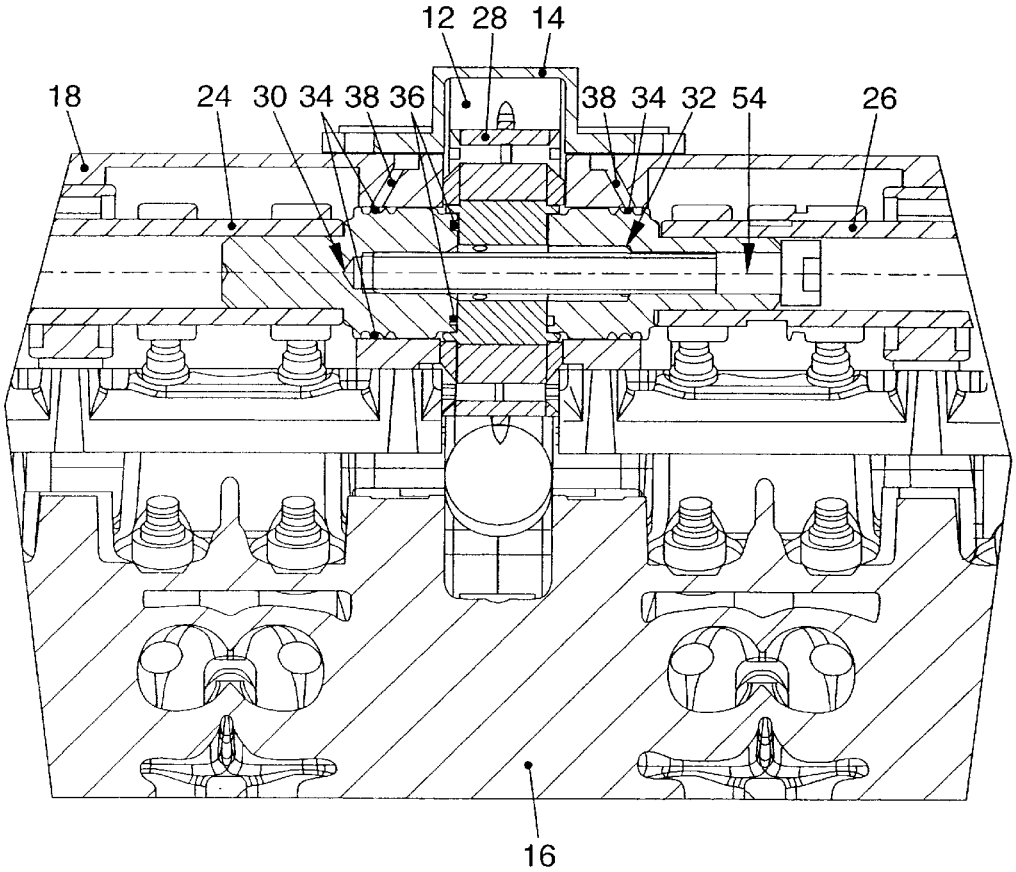
FIG. 2 is a sectional view along line B—B of FIG. 1.

The vane cell adjusters 28 form thrust bearings for the associated camshaft halves; that is, the ends of the camshaft halves 24, 26 facing the vane cell adjusters 28 are supported by the vane cell adjusters 28 in the cylinder head shroud 18, as is especially clear in FIG. 2. As can also be derived from FIGS. 6–8, each of the vane cell adjusters 28 comprises a vane cell wheel 46 and an impeller 44 with vanes 42, which engage in the respective vane. cells 48 of the vane cell wheel 46 and thus divide each of the associated vane cells 48 into two chambers.

Figure 6:
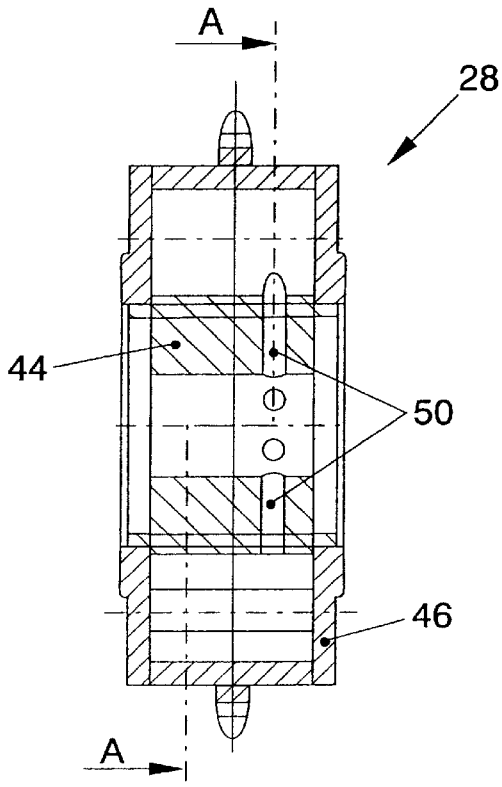
FIG. 6 is a longitudinal section of the vane cell adjuster according to FIG. 5.
Figure 5:
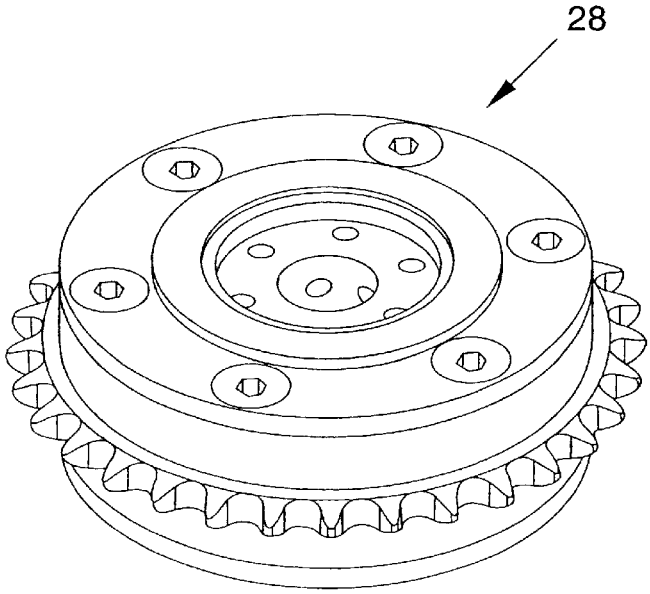
FIG. 5 is a perspective view of a camshaft adjuster in the form of a vane cell adjuster for an accessory drive according to the invention.
Figure 7:
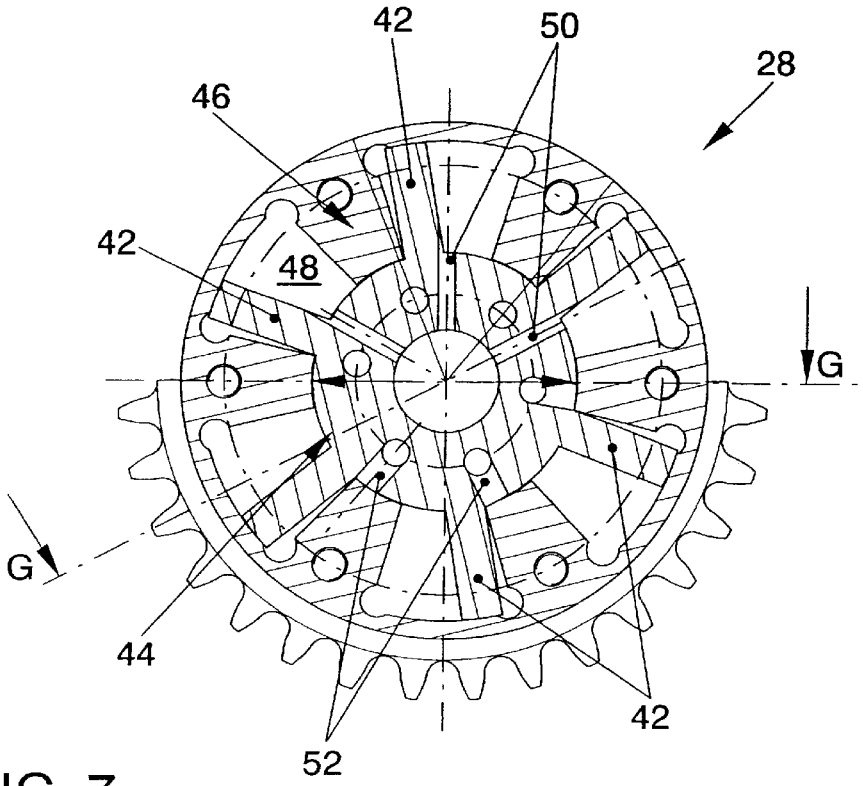
FIG. 7 is a sectional view along line A—A of FIG. 6.
Figure 8:
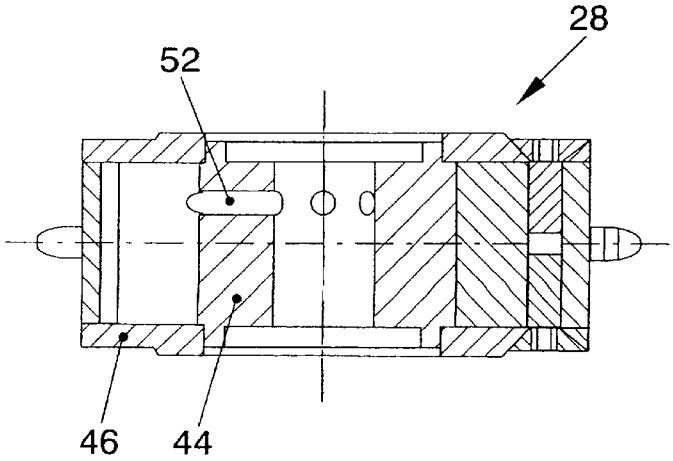
FIG. 8 is a sectional view along line G—G of FIG. 7.
Figure 12:
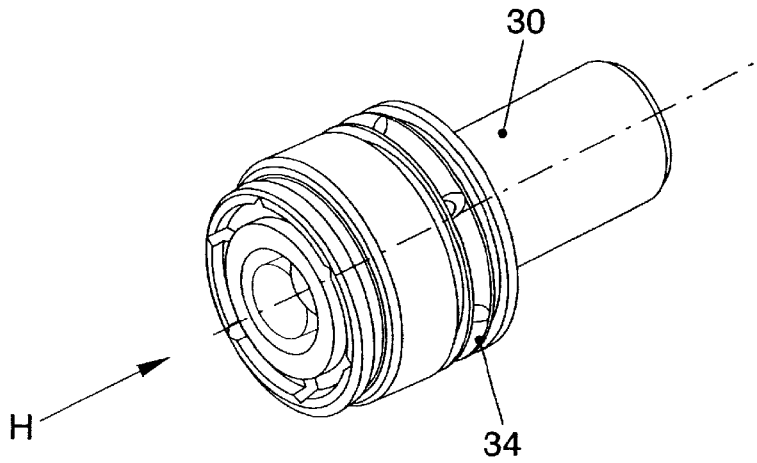
FIG. 12 is a perspective view of an end piece of the accessory drive to FIGS. 1–4.
Figure 13:
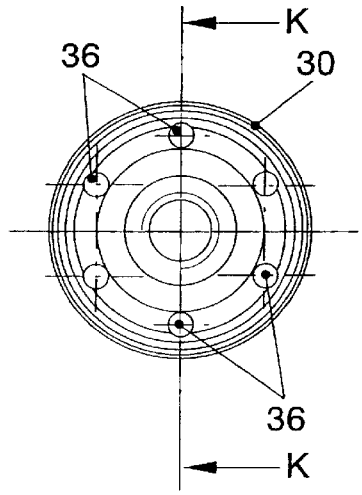
FIG. 13 is a view of the end piece of FIG. 12 looking in the direction of arrow H in FIG. 12.
Figure 14:
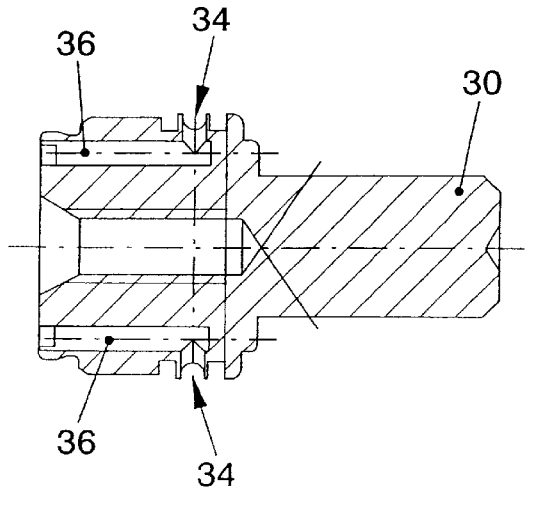
FIG. 14 is a sectional view of the end piece of FIG. 12 along the line K—K of FIG. 13.

The end pieces 30. 32, as can also be seen in FIGS. 12–15, have in each case circumferential grooves 34 and channels 36, through which oil is supplied to, and removed from, the vane cell adjusters 28. The grooves 34 are in fluid-conducting connection with corresponding oil channels 38 (FIGS. 2, 4) in the cylinder head cover 18, and the channels 36 are in fluid-conducting connection with corresponding oil supply channels 50, 52 in the vane cell adjuster 28, as can be seen in FIGS. 6–8. Here one end piece 30 has an external oil supply, and the other end piece 32 has an internal oil supply, so that one side of the vanes 42 of the impeller 44 (FIG. 7) can be subjected to oil pressure via the one end piece 30, while the opposite side of the vanes 42 of the impeller 44 can be acted on by oil via the other end piece 32. In other words, by way of the end pieces 30, 32, the chambers formed by the vanes 42 in the vane cells 48 arc supplied separately with hydraulic oil. Depending on the direction in which adjustment occurs, therefore, the oil is supplied via one of the two camshaft halves 26, 24 and carried away via the other camshaft half 24, 26. The displaced, returning oil runs across a valve flange 58 and into the chain shaft 12. FIGS. 12–14 illustrate an end piece 30 with external oil supply, whereas the other end piece 32 with internal oil supply can be seen only in FIGS. 2–4.

Figure 3:
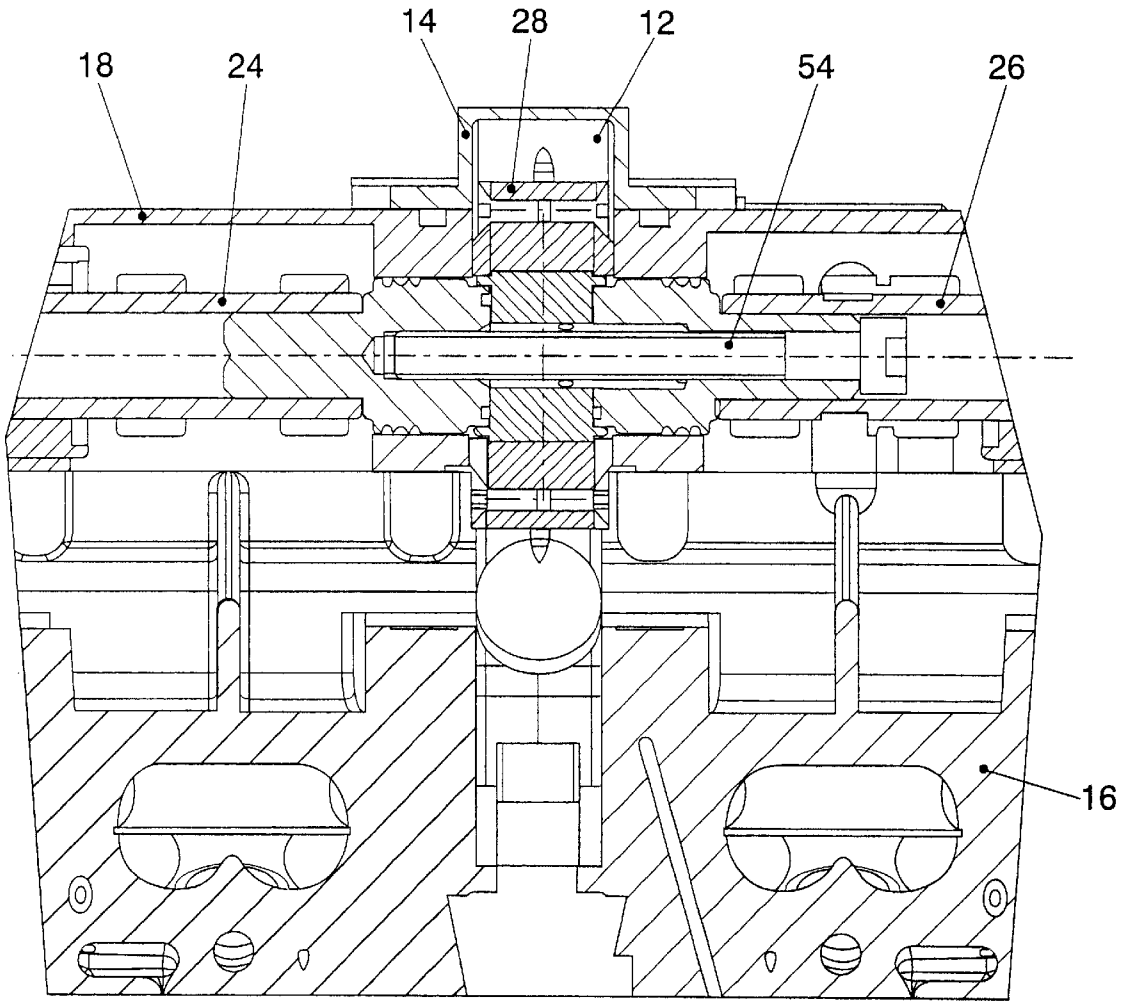
FIG. 3 is a sectional view along line C—C of FIG. 1.
Figure 4:
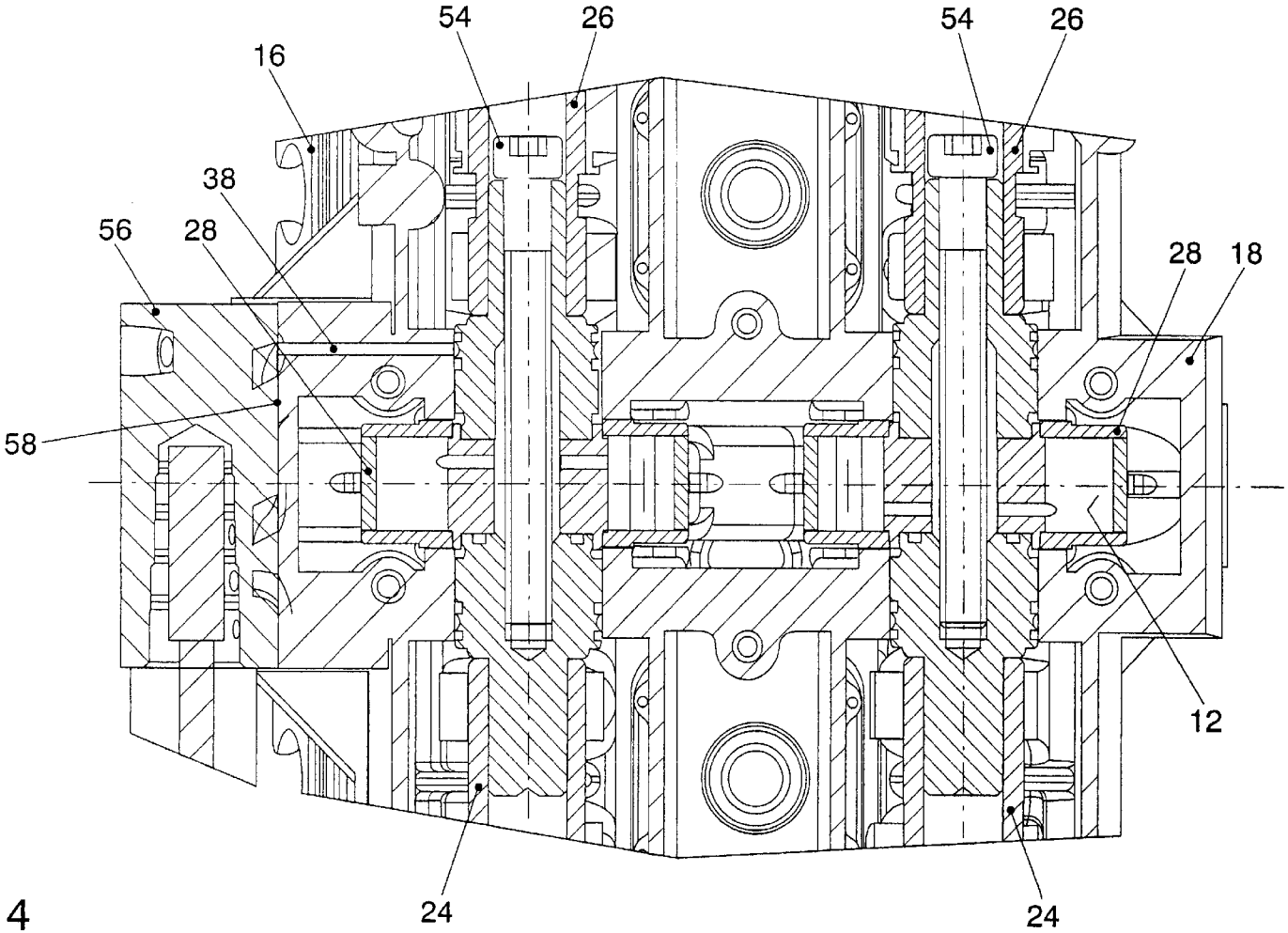
FIG. 4 is a sectional view along line F—F of FIG. 1.

As can also be derived from FIGS. 2–4, the end pieces 30, 32 and the associated vane cell adjusters 28 are clamped together by a central screw 54.

Figure 16:
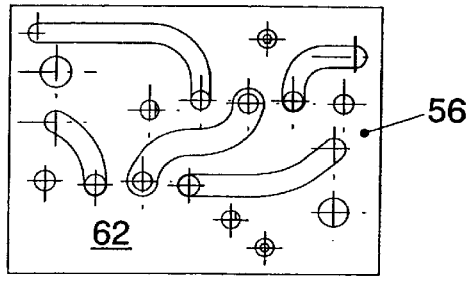
FIG. 16 is a view of the valve flange housing of FIG. 15 looking in the direction of arrow L of FIG. 15.
Figure 17:
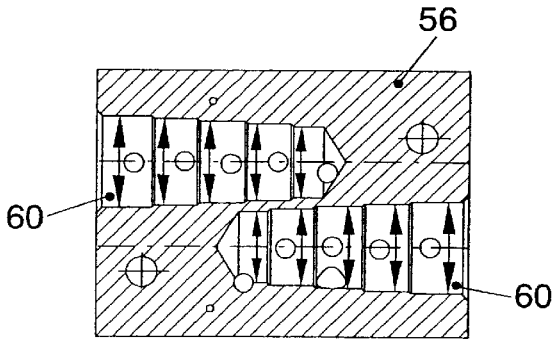
FIG. 17 is a sectional view of the valve flange housing of FIG. 15 along line M—M of FIG. 15.

The external oil supply or control of the vane cell adjusters 28 by means of oil pressure through the oil channels 38 in the cylinder head 18 occurs by way of a valve flange housing 56 (FIGS. 1, 4), which is flanged via the valve flange 58 (FIG. 1) to the cylinder head cover 18. The design of the valve flange housing 56 is shown in more detail in FIGS. 15–17. The valve flange housing 56 comprises an opening 60 for the insertion of a 4/2-way proportional valve 40 (FIG. 21) and corresponding oil channels, which have openings on a surface 62 of the valve flange housing 56 on the valve flange side, which openings are laid out to correspond with the associated openings in the valve flange 58. Because two vane cell adjusters 28 are to be actuated in one cylinder bank, that is, one adjuster for the camshaft halves of the exhaust valves and one for the camshaft halves of the intake valves, two openings 60 are provided for the 4/2-way proportional valves 40 in one valve flange housing 56, as can be seen in FIG. 17.

Figure 9:
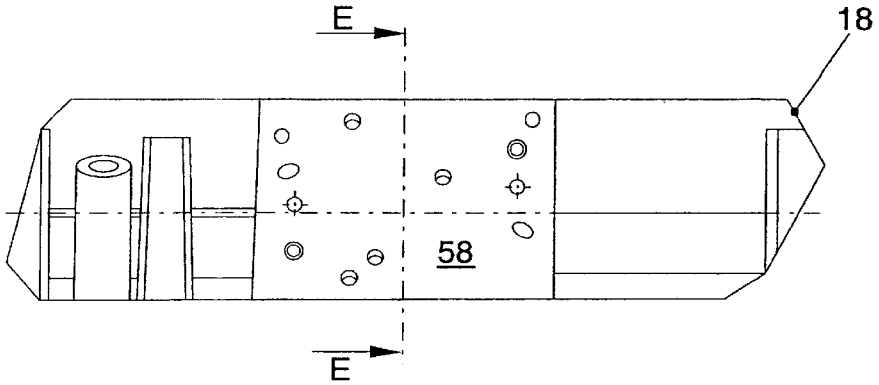
FIG. 9 is a side view of the cylinder head shroud on a valve flange in the area of a chain shaft.
Figure 10:
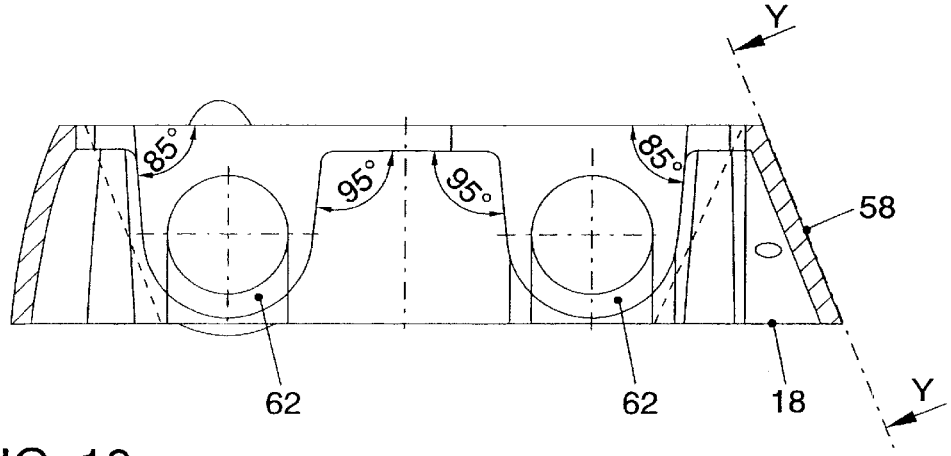
FIG. 10 is a sectional view of the cylinder head shroud of FIG. 9 along line E—E.
Figure 11:
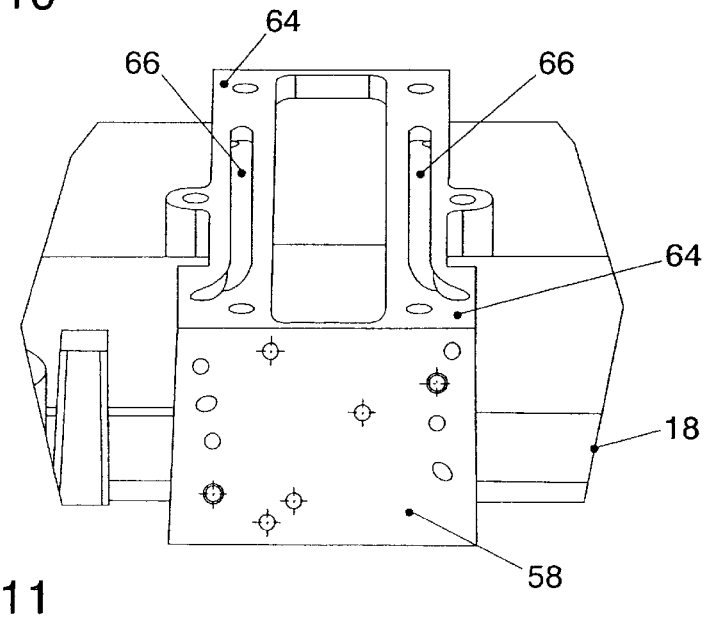
FIG. 11 is a view of the cylinder head shroud of FIG. 9 along the plane Y—Y of FIG. 10.
Figure 18:
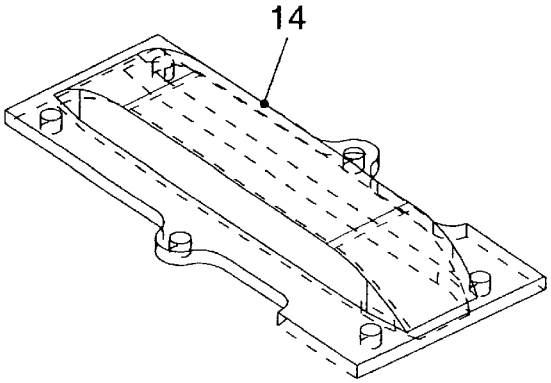
FIG. 18 is a perspective view of a chain shaft cover.

The valve flange 58 can be seen in the detailed illustration of the cylinder head cover or cylinder head shroud 18 according to FIGS. 9–11. The thrust bearings 62 for the camshaft halves can also be seen in FIG. 10. FIG. 11 illustrates, among other things, an expanded support surface 64 for the chain shaft cover 14. Grooves 66 are provided in the expanded support surface 64 to establish a pressure oil connection leading from the valve flange 58 to the end pieces 30, 32 on the exhaust side 22 of the cylinder head shroud 18. As can also be seen in FIG. 18, the chain shaft cover 14 is designed with an outward bulge to make space available for the vane cell adjuster 28. The chain shaft cover 14 also seals off the top of the grooves 66 in the support surface 64.

Oil under pressure for actuating the vane cell adjuster 28 is present at various locations in the engine. So that the adjuster 28 can be supplied adequately, it is especially preferred that the oil be obtained near an oil pump. A critical situation for the oil supply is the condition called "hot idle", in which the engine is throttled back from high load to no load. The hot oil is less dense and thus flows through narrower gaps. For this reason, hot idle is characterized by a very low oil pressure in the system.

In the vane cell adjuster 28 designed in accordance with the invention, six chambers are provided with a maximum outside diameter of 72 mm. The angle of adjustment is between a crank angle of 40° and 45°. To optimize the space available, the chain wheel is integrated into the adjuster 28. The adjuster 28 is arranged in the path of the chain. The valves 40 (FIG. 21) are supplied with engine oil under pressure (0.5–5 bars) through an additional line from the oil gallery of the cylinder head 16. At the adjusters 28, the oil is conducted via the grooves 66 (FIG. 11) in the sealing surface 64 of the chain shaft cover 14. The oil flows across the camshaft bearings on both sides of the chain shaft 12 and arrives at the camshafts 24, 26, which send it along to the adjuster 28. An excessive loss of oil is avoided by sealing rings in the camshaft bearings. For continuous bearing lubrication, the camshaft bearings are also supplied with oil via the oil gallery of the cylinder head 16. For the control of the two adjusters 28, camshaft TDC sensors are provided on the intake and exhaust camshafts. It is preferable for enginespeed control units to take care of the control functions. When the engine is started, the exhaust camshaft is advisably in an early position. The intake and exhaust camshafts are adjusted continuously. The vane cell adjusters 28 are mounted in the chain shaft 12 with the chains already installed (not shown). The adjusters and the camshafts are connected frictionally to each other and thus prevented from relative rotation. The limits of the adjustment range are set for the geometry of the engine, or the geometry of the piston is modified as required (freedom of valve movement). Adequate oil pressure at the adjuster 28 is guaranteed by sufficiently large channel cross sections, low leakage rates, and a well-designed oil pump. The layout should be made in such a way that even the state of hot idle (thin oil, low pump rpm's) will not present a problem.

Figure 15:
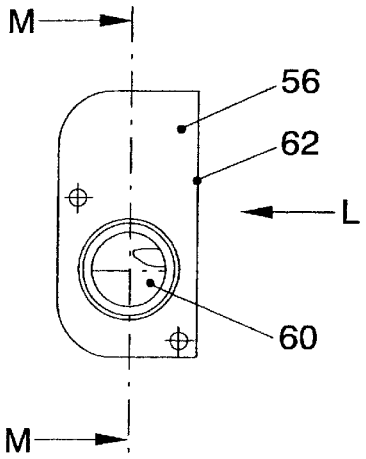
FIG. 15 is a side view of a valve flange housing for an accessory drive according to the invention.

Because the valve flange 58 is provided on the intake side 20, few parts are required for the engine, because sufficient space is available on the intake side 20 for the valve flange 58 and the valve flange housing 56 mounted on top on all three cylinder banks of the engine. Thus the design of the valve flange 58 and of the valve flange housing 56 is the same for all three cylinder banks. The valves 40 can be mounted in two different ways. One possibility is to integrate the valve seats and lines directly into the cylinder head shroud 18. Leaks can be avoided in this way. The second possibility is preferred for reasons of production technology. Here the valve flange housing 56 is provided for the installation of the valves 40, as can be seen in FIGS. 15–17. This valve flange housing 56 holds the valves 40 and conducts the oil via grooves 66 in the sealing surface 64 between the valve flange 58 and the cylinder head shroud 18 to the supply bores. The sealing surface 64 is advisably provided with a metal seal, which seals off the individual lines against each other and the entire flange 58, 56 against the environment. The oil is supplied to the system via separate lines from, for example, the crankcase. In a further elaboration of the invention, the supply bores are formed directly in the crankcase. The entrance for the oil stream into the valve flange housing 56 (see FIGS. 15–17) is the bore on the side. From there. the oil is conducted to the pump side of both proportional valves 40 in the middle. The proportional valves 40 distribute the oil to the various control lines. The return flow to the tank passes through bores and proceeds directly to the chain shaft 12, from which it is then carried assay. In the design of the valve flange housing 56 or of the valve flange 58, the smallest possible number of bores is provided in the cylinder head shroud 18. By combining individual lines of the same type together such as pump side lines and tank side lines, it is necessary to produce only a few complicated bores.

As previously mentioned, the camshafts 24, 26 are used to conduct the oil under pressure to the adjusters. For this purpose, the oil is supplied to the camshafts 24, 26 via the camshaft bearings and to the adjusters across the end surface of the frictionally-locked connection between the camshafts 24, 26 and the adjusters 28. The camshafts 24, 26 are assembled camshafts. Cams and bearing rings are mounted on a tube by expanding the tube from the inside and thus subjecting the tube to plastic deformation. The starting point for the production of the camshaft is a tube of standard dimensions. The length is adapted to the camshaft to be produced. The cams and bearing rings are attached by plastic deformation of the tube. The cams are positioned and held in place. A probe is used to supply the areas under the cams and bearing shells with oil pressure, so that the tube and the parts are deformed. Measurement sensors record the deformation. Just enough pressure is applied to cause the cams and bearing rings to undergo elastic deformation, whereas the tube has undergone plastic deformation at the same time. After the oil pressure has been released, the parts shrink more than the tube does. A friction-locking connection is therefore created between the parts and the tube, which is sufficient to secure the cams permanently against relative rotation. The width of the friction-locking connection is important for the strength of the frictional bond. If the part is not wide enough, the connection cannot transmit enough force. Another point to be considered is that the probe to be used in the production process requires a certain freedom of movement at its tip, so that the seals, which are intended to hold the applied oil pressure, remain securely mounted on the probe. The camshafts used in the past for engines of this type, however, have presented the problem that the end pieces 30, 32 are not wide enough to conduct oil through the camshaft. Conventional end pieces are simply pushed over the outside of the camshaft. In this case it is impossible to integrate an oil line of sufficient size in the end piece. It is impossible to modify the end piece, however, because the minimum size of the friction surface and the freedom of movement of the probe must be accommodated. Therefore, according to the invention, a much different type of end piece is provided. Because the end pieces 30, 32 are inserted into the camshaft tube, the end pieces 30, 32 can be designed both so that the oil lines to the adjuster can be integrated into them and so that the bearing surfaces can be arranged to ensure a sufficient supply of oil to the thrust bearings. The end pieces 30, 32 are shrunk-fit into the tube of the camshaft after the cams have been mounted. The tube can be shortened after the mounting of the cams, as a result of which the end pieces 30, 32 can be allowed to be longer. The only condition is that a certain minimum distance of 5 mm must be provided between the cam and the bearing, so that the end piece and the tube can also be welded together by laser welding. The advantage of this solution is that it preserves the load-bearing character of this side of the bearing. The bores in the cylinder head 16 used to supply the bearings can continue to be used. In addition, the oil from the radial bearing can also be used for the thrust bearing, before it returns to the chain shaft 12. The area of the control oil pressure for the adjuster 28 is sealed off in the radial direction by rings.

With respect to the cylinder head 16, somewhat more space is created in the area of the chain shaft 12 in comparison with conventional W18 engines. The only way this can be done in the case of conventional cylinder heads 16 is to remachine them. In the cylinder head, a seat for the adjuster 28 is created to facilitate assembly. The adjusters 28 must have enough free space to move freely when they are in their final position. To facilitate installation, the adjuster 28, however, should not be able to pass completely through the chain shaft 12. The chain shaft cover 14 is considerably wider than conventional chain shaft covers. The flange design is modified to accommodate the new screwed connection using the screws of the cylinder head shroud 18.

The sequence of steps comprising the assembly process is explained on the basis of a cylinder bank 10 by way of example with reference to FIGS. 19–21. Because of the center takeoff, the accessory drive together with the chains must be mounted before the cylinder head 16. After the cylinder head 16 has been mounted, the chain (not shown) is hanging loosely in the chain shaft 12. Now the adjusters 28, i.e., the sprocket wheels, are installed. FIG. 19 shows this state, but without the chains. Because the adjusters 28 extend only a short distance into the cylinder head, the chain can be laid over the sprocket wheels as soon as these wheels have been placed in the chain shaft 12. Because of the seats provided for the sprocket wheels in the cylinder head 16, the sprocket wheels stand upright in the chain shaft and do not fall into the shaft. Now the cylinder head shroud 18 is set in place. The camshafts 24, 26 are preinstalled inside the shroud. When the cylinder head shroud 18 has been set in place, the camshafts can still be pushed in the axial direction. It must be remembered, however, that the roller drag levers may not be canted. The axial movement, therefore, should not be too great. The thrust bearing between the adjuster 28 and the cylinder head shroud 18 requires careful mounting of the shroud 18.

Now the camshafts 24, 26 and the adjusters 28 or the sprocket wheel are brought into their final positions. An installing hook is used to lift the adjusters, and the camshafts 24, 26 are pushed inward. Camshaft straightedges are used to ensure that the camshafts 24, 26 are properly positioned. Once the adjusters 28 are in the proper position radially, the camshafts 24, 26 are pushed into their end positions. This procedure is done twice, once for the intake side and once for the exhaust side. Once the camshafts and the adjusters have been connected to each other, the cylinder head shroud 18 is screwed down (FIG. 20).

Once all three cylinder heads have been prepared in this way, the valve drive is aligned with the crankshaft. For this purpose, the cylinder 1 is set at ignition TDC. The camshaft straightedges are used to position the camshafts for this. The adjusters are prevented from rotating by pins. As soon as all the components are in position, the camshafts are screwed to each other and to the adjuster. The friction-locking connection thus obtained is secure against a rotation of 1.7 at an assumed peak torque of the camshaft of 40 Nm; preferably, however, it is secure against a rotation of 2.3.

The assembly can also be improved by the use of bearing blocks to support the camshafts. This also leads to an improvement in the frictional performance of the bearings, because the bearing diameters can be decreased.

Then the chain shaft cover 14 with its gasket and the valve flange 56, 58 with its gasket and the valves are mounted (FIG. 21).

The advantage of the assembly procedure described above is to be found in the accuracy and ease with which the camshafts can be positioned. It is impossible for the camshafts to be positioned incorrectly, because the camshaft straightedges can be put in only one installation position and can assume only one angle. There may be no departure from this proven principle when the new solution based on the adjuster 28 is used.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An accessory drive for valves of an internal combustion engine, comprising: a camshaft divided into two halves; a camshaft gear wheel provided between the two halves of the camshaft; and a hydraulic camshaft adjuster arranged between the two halves of the camshaft so as to act as a thrust bearing for the halves of the camshaft, each half of the camshaft having a hydraulic fluid connection extending via the thrust bearing to the camshaft adjuster.

2. An accessory drive according to claim 1, wherein the camshaft gear wheel is integrated into the camshaft adjuster.

3. An accessory drive according to claim 1, wherein the camshaft adjuster is a vane cell adjuster.

4. An accessory drive according to claim 3, wherein the vane cell adjuster has an impeller and a vane cell wheel, the impeller having five or six vanes and the vane cell wheel having five or six vane cells, respectively.

5. An accessory drive according to claim 3, wherein the vane cell adjuster has a wall thickness of 3 mm; an outside diameter of 66 mm; an inside diameter of 34 mm to 36 mm; a width of 21 mm to 24 mm; an effective area per vane of 315 $mm^2$ to 384 $mm^2$; and an effective diameter of 25 mm to 26 mm.

6. An accessory driver according to claim 5, wherein the vane cell adjuster has a width of 22 mm.

7. An accessory driver according to claim 5, wherein the vane cell adjuster has an effective diameter of 25.5 mm.

8. An accessory driver according to claim 5, wherein the vane cell adjuster has an effective area per vane of 330 $mm^2$.

9. An accessory driver according to claim 5, wherein the vane cell adjuster has an effective area per vane of 360 $mm^2$.

10. An accessory driver according to claim 5, wherein the vane cell adjuster has an effective area per vane of 336 $mm^2$.

11. An accessory driver according to claim 5, wherein the vane cell adjuster has an effective area per vane of 372 $mm^2$.

12. An accessory drive according to claim 1, wherein the camshaft adjuster is connected to each of the associated halves of the camshaft by an end piece, each end piece having a hydraulic fluid connection that extends between the half of the camshaft in question and the camshaft adjuster.

13. An accessory drive according to claim 12, wherein when two end pieces are assigned to one camshaft adjuster, the hydraulic fluid connection is external for one end piece and the hydraulic fluid connection is internal for the other end piece.

14. An accessory drive according to claim 12, wherein the end piece is pushed into an interior space in the associated half of the camshaft.

15. An accessory drive according to claim 12, and further comprising a central screw provided so as to clamp the camshaft adjuster to the associated, end-mounted end pieces.

* * * * *